US011225813B2

(12) United States Patent
Wyler

(10) Patent No.: US 11,225,813 B2
(45) Date of Patent: Jan. 18, 2022

(54) THEFT-PREVENTION ANCHORING DEVICE

(71) Applicant: Darcy Wyler, Wylie, TX (US)

(72) Inventor: Darcy Wyler, Wylie, TX (US)

( * ) Notice: Subject to any disclaimer, the term of this patent is extended or adjusted under 35 U.S.C. 154(b) by 0 days.

(21) Appl. No.: 17/230,790

(22) Filed: Apr. 14, 2021

(65) Prior Publication Data

US 2021/0317687 A1 Oct. 14, 2021

Related U.S. Application Data

(60) Provisional application No. 63/009,925, filed on Apr. 14, 2020.

(51) Int. Cl.
*E05B 73/00* (2006.01)
*G08B 3/10* (2006.01)
*G08B 13/12* (2006.01)

(52) U.S. Cl.
CPC ..... *E05B 73/0005* (2013.01); *G08B 3/10* (2013.01); *G08B 13/12* (2013.01)

(58) Field of Classification Search
CPC ..... E05B 73/0005
See application file for complete search history.

(56) References Cited

U.S. PATENT DOCUMENTS 5,136,759 A * 8/1992 Armour, II ..... A44B 18/00 24/16 R
5,610,585 A * 3/1997 Jobe ..... E05B 73/00 340/568.6
6,138,882 A * 10/2000 Buettner ..... A45C 13/00 190/102
6,606,768 B2 * 8/2003 Henry ..... A45F 5/00 24/298
8,334,772 B2 * 12/2012 Triggiani ..... A45C 13/185 340/568.1
8,371,000 B1 * 2/2013 Schultz ..... B65D 63/10 24/306
11,002,043 B2 * 5/2021 Schuur ..... A63C 11/006
2009/0194210 A1 * 8/2009 Montross ..... A45C 13/30 150/154
2011/0199210 A1 * 8/2011 McLean ..... G08B 21/0297 340/568.1
2013/0086774 A1 * 4/2013 Krasinski ..... A45C 13/001 24/16 R
2016/0348402 A1 * 12/2016 Barron ..... E05B 67/003
2017/0247915 A1 * 8/2017 Schuur ..... A45F 3/14
2019/0010729 A1 * 1/2019 Steadman ..... E05C 19/184
2019/0264471 A1 * 8/2019 Schuur ..... A45F 3/14

* cited by examiner

*Primary Examiner* — Travis R Hunnings

(57) ABSTRACT

A theft-prevention anchoring device is an apparatus that secures a bag to a secure structure. The apparatus includes an anchoring band, a band fastener, and a security cable. The anchoring band houses the security cable and protects the bag from any damage. The anchoring band also provides a style according to the preferences of a user. The band fastener attaches a first band end of the anchoring band with a second band end of the anchoring band so that the anchoring band may loop around the bag and the secure structure. The band fastener includes a first interlocking piece and a second interlocking piece. The first interlocking piece is engaged to the second interlocking piece. Moreover, the band fastener is configured to generate a loud audible sound as the first interlocking piece is disengaged from the second interlocking piece. The security cable provides the structural integrity for the apparatus.

18 Claims, 7 Drawing Sheets

THEFT-PREVENTION ANCHORING DEVICE

The current application claims a priority to the U.S. Provisional Patent application Ser. No. 63/009,925 filed on Apr. 14, 2020.

FIELD OF THE INVENTION

The present invention generally relates to security devices. More specifically, the present invention is a theft-prevention anchoring device.

BACKGROUND OF THE INVENTION

In present times, individuals are known to carry a variety of personal bags and items during routine daily activities. These laptops cases, backpacks, purses, tote bags, briefcases, portfolios, or other bags are prime targets for thieves, often containing valuables such as phones, wallets, personal computers, cameras, sunglasses, jewelry, sensitive documentation, or any number of other precious cargo that cannot be readily replaced. Thieves are generally not interested tin confronting an aware victim, preferring to target unattended bags or inattentive victims, simply grabbing a bag placed out of view (such as beneath a table, in a shopping cart, etc.) and making their escape before the victim even notices that their valuables are gone. For high-security couriers and transporters, it is a known practice to handcuff oneself to a package; but this is impractical and uncomfortable for general use. Further, such an ostentatious method of securing one's personal belongings may draw more attention (and risk) from potential thieves, contrary to the intent of the practice.

The present invention aims to provide a means of temporarily, discreetly securing a personal item to a permanent or at least cumbersome object, frustrating any attempts to simply walk-off with said bag. Further, it is contemplated that the present invention will feature an integral audible alarm generator. This alert is considered to be inherent to the form and function of the present invention, requiring no external power supplies, circuitry, triggers, or other components associated with a conventional alarm system. Additionally, specific material features of the present invention will lend sufficient strength to the overall form of the present invention to prevent a potential thief from damaging the present invention in an attempt to circumvent the alert. It is contemplated that the present invention will be functionally immune to short-term damage from bolt cutters, knives, torches, or any other tool known to be used by thieves to sever similar systems.

DETAILED DESCRIPTIONS OF THE INVENTION

All illustrations of the drawings are for the purpose of describing selected versions of the present invention and are not intended to limit the scope of the present invention.

The present invention is a theft-prevention anchoring device. The present invention secures a personal item, preferably a bag, with a secure structure, such as a chair or shopping cart, so that the personal item may not be quickly and easily taken by an individual passing a user with the personal item. The personal item may also be a suitcase, a briefcase, a smart device case, and so on. The present invention not only deters an individual from stealing the personal item but audibly alerts the user of any mischief regardless of the noise-level of the surrounding environment. The personal item is preferably secured underneath a protruding structure or within a bulky or large mobile object. The present invention reduces a potential theft, requiring a more involved attempt to steal the personal item.

Figure 5:
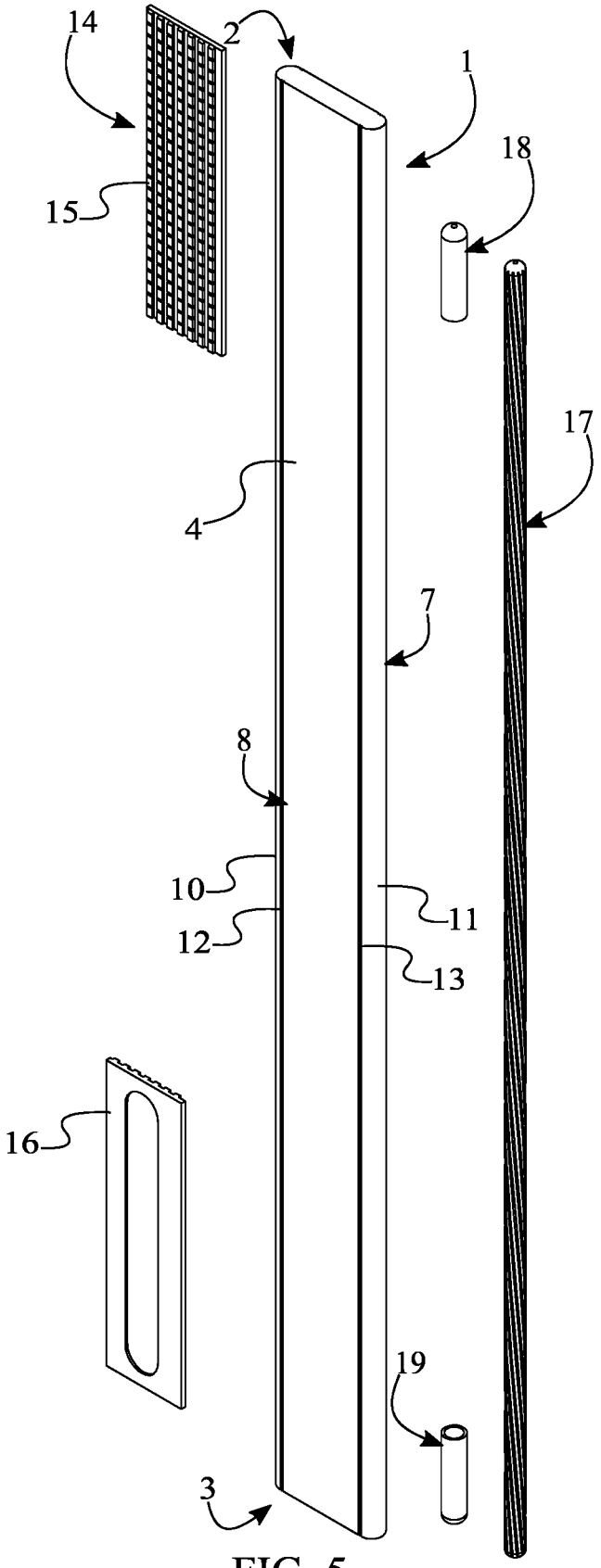
FIG. 5 is an exploded view of the second embodiment of the present invention.
Figure 6:
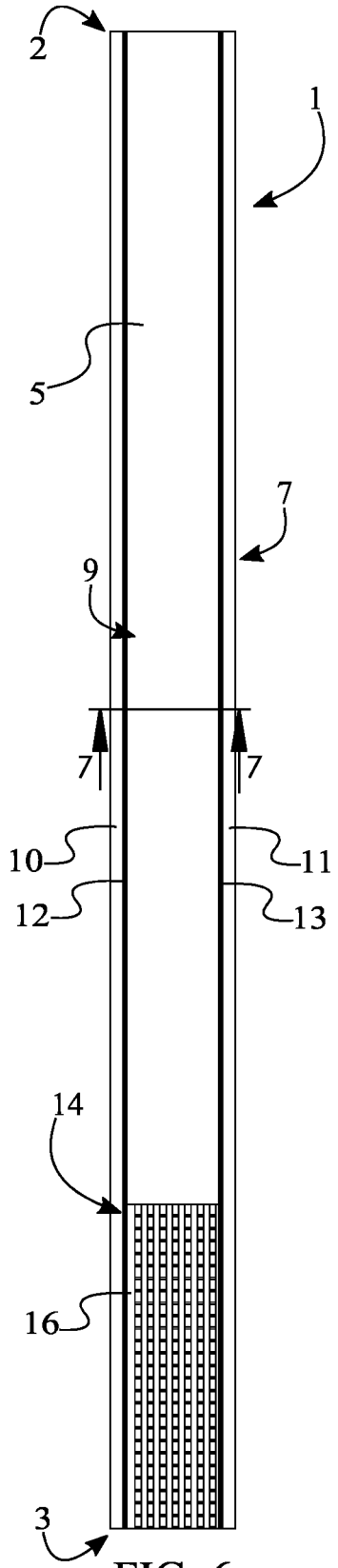
FIG. 6 is a rear side view of the second embodiment of the present invention.
Figure 7:
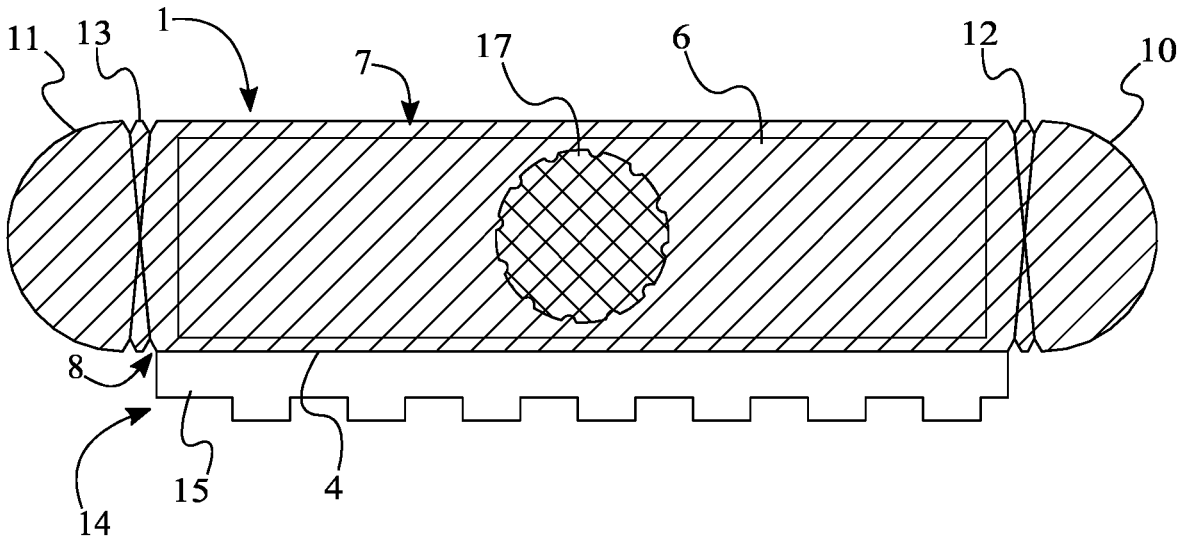
FIG. 7 is a cross-section view taken along line 7-7 in FIG. 6.

In order to increase the difficulty of theft of a personal item, the present invention may comprise an anchoring band 1, a band fastener 14, and a security cable 17, seen in FIG. 5 and FIG. 7. The anchoring band 1 provides a tough and flexible connection between the personal item and a secure structure. The anchoring band 1 comprises a first band end 2, a second band end 3, an inner planar surface 4, and an outer planar surface 5. The first band end 2 and the second band end 3 allow the anchoring band 1 to loop around both the personal item and the secure structure. The inner planar surface 4 presses against the personal item and the secure structure, and the outer planar surface 5 is exposed to the surrounding environment. The band fastener 14 provides the removable connection between the first band end 2 and the second band end 3. More specifically, the band fastener 14 comprises a first interlocking piece 15 and a second interlocking piece 16. The first interlocking piece 15 allows the first band end 2 to connect with the second band end 3. Likewise, the second interlocking piece 16 allows the second band end 3 to connect with the first band end 2. In a preferred embodiment of the present invention, the band fastener 14 is a hook-and-loop band fastener, wherein the first interlocking piece 15 is a hooks portion of the hook-and-loop band fastener, and the second interlocking piece 16 is a loops portion of the hook-and-loop band fastener. It is understood in alternate embodiments of the present invention, the first interlocking piece 15 is a loops portion of the hook-and-loop band fastener, and the second interlocking piece 16 is a hooks portion of the hook-and-loop band fastener. The hook-and-loop band fastener serves as the distinct audible alert for the present invention so that a user is alerted to an attempted removal of the present invention from the personal item. The security cable 17 prevents an individual from simply tearing or breaking the anchoring band 1 in order to quickly and discretely remove and separate the personal item from the secure structure. The security cable 17 serves as a functional endoskeleton for the present invention. The security cable 17 is preferably made of a cut-resistant material. More specifically, the security cable 17 preferably comprises a plurality of interwoven steel wire strands with high-tensile strength and resistance to most common forms of damage. Furthermore, it is understood that the security cable 17 may comprise various materials or combinations of materials that is substantially resistant to heat, shear forces, and environmental degradation.

Figure 1:
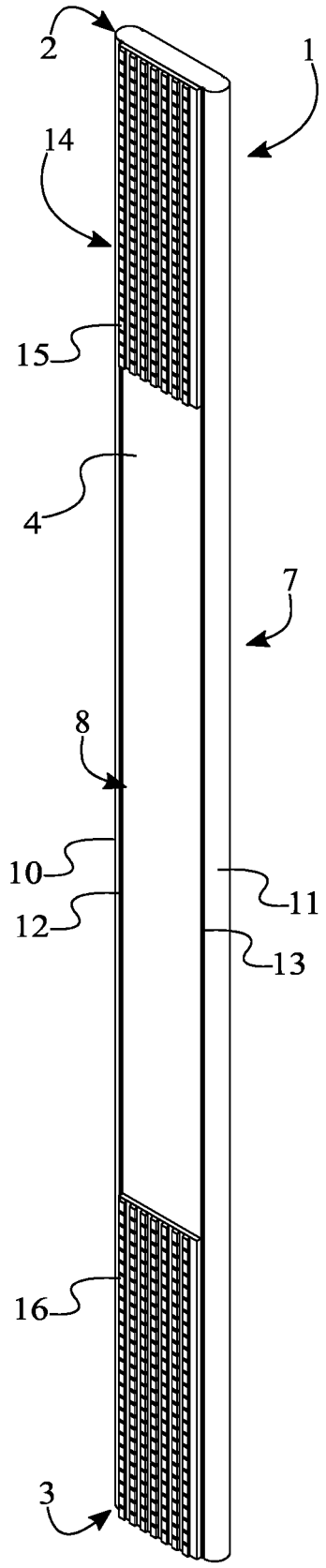
FIG. 1 is a perspective view of a first embodiment of the present invention.
Figure 2:
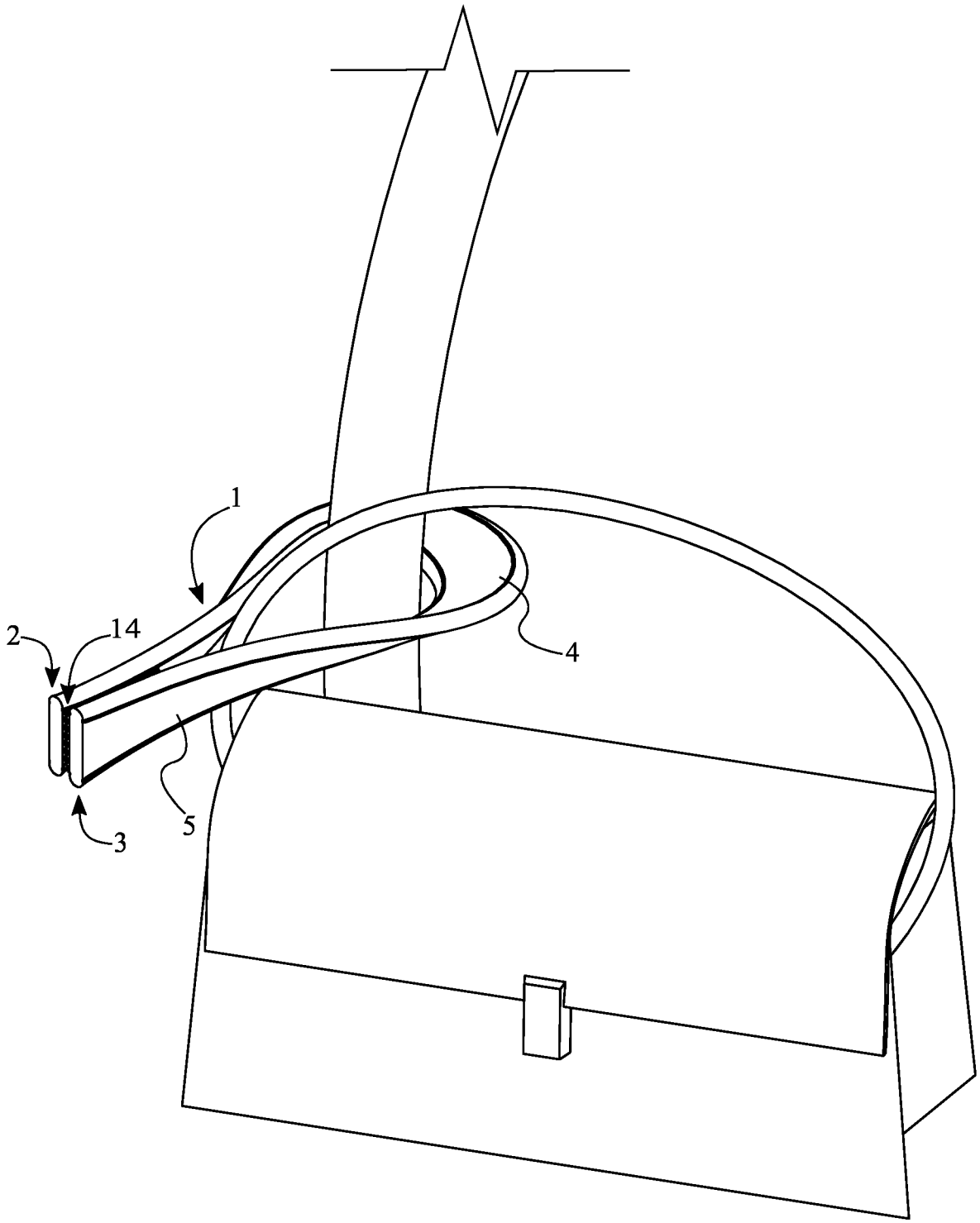
FIG. 2 is a perspective view of the first embodiment of the present invention in a looped configuration.
Figure 3:
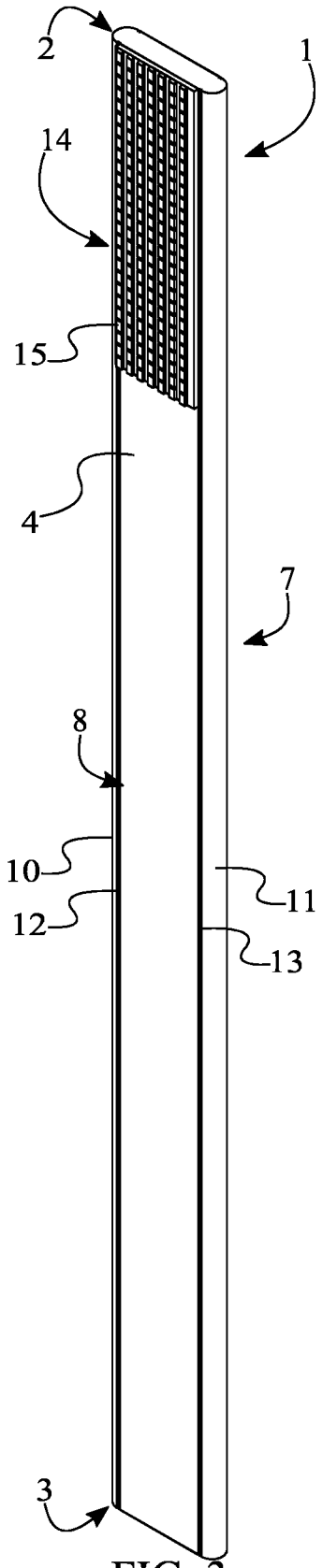
FIG. 3 is a perspective view of a second embodiment of the present invention.
Figure 4:
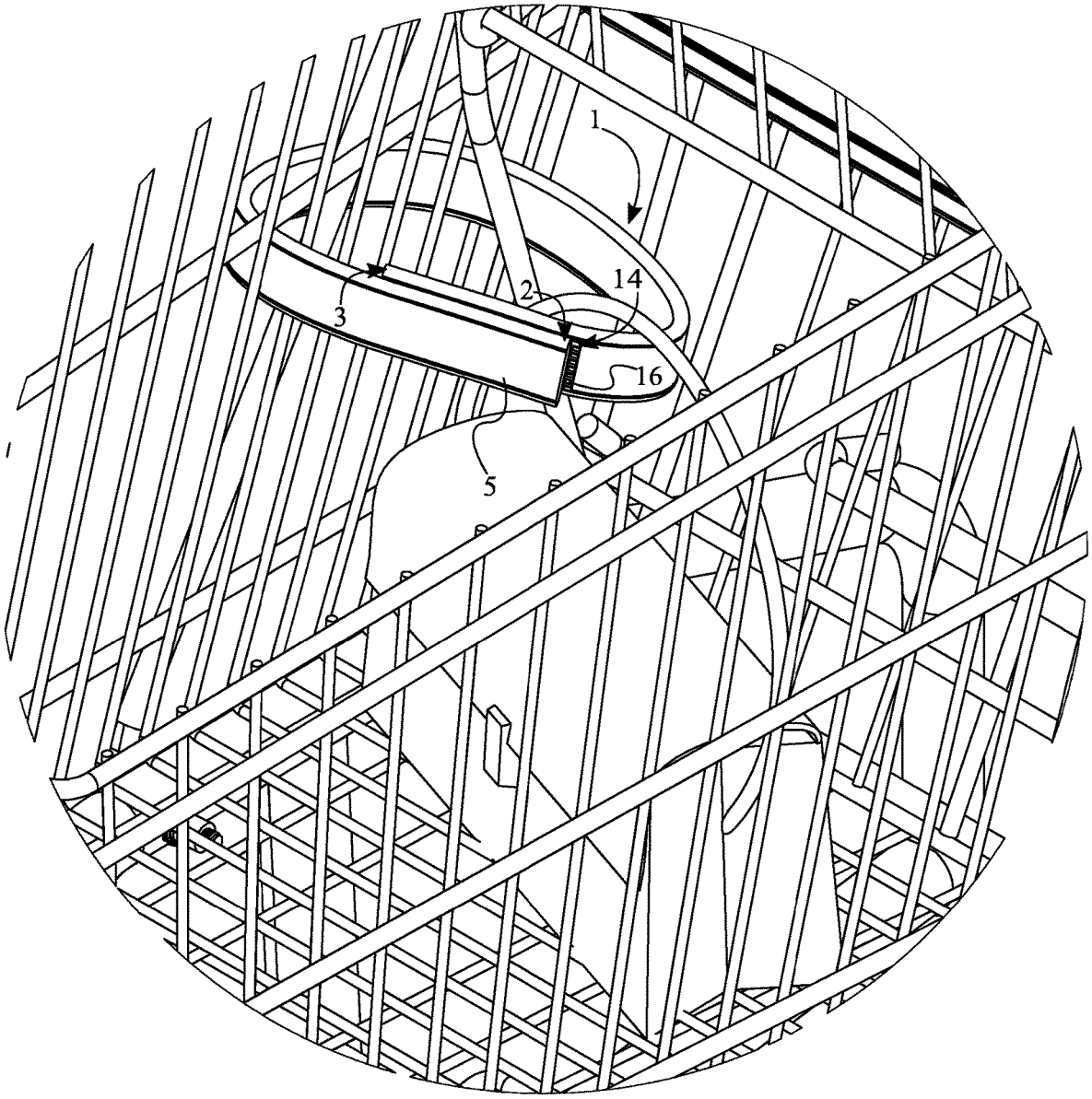
FIG. 4 is a perspective view of the second embodiment of the present invention in a looped configuration.

The overall arrangement of the aforementioned components safely attaches a bag to a secure structure and audibly alerts a user if a personal item is being separated from the present invention. In order to create a loop with the anchoring band 1, the first band end 2 is positioned opposite the second band end 3 along the anchoring band 1, as seen in FIG. 1, FIG. 3, FIG. 5, and FIG. 6. The inner planar surface 4 is positioned opposite the outer planar surface 5 about the anchoring band 1, thereby providing non-abrasive surfaces against the personal item and the surrounding environment. The anchoring band 1 may be secured in a looped configuration as the first interlocking piece 15 is fixed onto the anchoring band 1, adjacent to the first band end 2, and the second interlocking piece 16 is fixed onto the anchoring band 1, adjacent to the second band end 3. In a first embodiment of the present invention, the first interlocking piece 15 and the second interlocking piece 16 are fixed onto the inner planar surface 4 such that the looped configuration tapers towards the first band end 2 and the second band end 3, as seen in FIG. 1. In a second embodiment of the present invention, the first interlocking piece 15 is fixed onto the inner planar surface 4, and conversely, the second interlocking piece 16 is fixed onto the outer planar surface 5, seen in FIG. 3, FIG. 5, and FIG. 6. In this second embodiment, the first band end 2 overlaps with the second band end 3. The security cable 17 is integrated into the anchoring band 1 and is positioned along the anchoring band 1, thereby structurally reinforcing the anchoring band 1 and preventing both the user and the personal item from coming into direct contact with the rougher surfaces of the security cable 17. The first interlocking piece 15 is engaged to the second interlocking piece 16, thereby locking the anchoring band 1 in the looped configuration and attaching the personal item with a secure structure. The user is alerted of an attempted theft as the band fastener 14 is configured to generate a loud audible sound as the first interlocking piece 15 is disengaged from the second interlocking piece 16. More specifically, the loud audible sound is comparable to a tearing noise that will automatically take the attention of the user, if not a nearby individual.

The anchoring band 1 provides both durability and style as the anchoring band 1 may further comprise an elongated structural body 6 and a band sleeve 7, seen in FIG. 1, FIG. 3, FIG. 5, FIG. 6, and FIG. 7. The elongated structural body 6 houses and cushions the security cable 17 against the personal item. The band sleeve 7 protects and conceals the elongated structural body 6. The band sleeve 7 is preferably made of a fire-retardant material and a cut-resistant material. The elongated structural body 6 is positioned within the band sleeve 7, thereby providing the user with various prints and designs along the band sleeve 7 to be exposed to the surrounding environment. The structural integrity of the present invention is maintained as the security cable 17 is integrated into the elongated structural body 6.

In the preferred embodiment of the present invention, the band sleeve 7 may comprise an inner fabric strip 8, an outer fabric strip 9, a first fastening seam 12, and a second fastening seam 13, also seen in FIG. 1, FIG. 3, FIG. 5, FIG. 6, and FIG. 7. The inner fabric strip 8 and the outer fabric strip 9 define smooth and continuous surfaces for the anchoring band 1. Moreover, the inner fabric strip 8 and the outer fabric strip 9 each comprise a first lengthwise edge 10 and a second lengthwise edge 11. The first fastening seam 12 and the second fastening seam 13 reinforces the connection of the band sleeve 7 around the elongated structural body 6. The elongated structural body 6 is concealed by the inner fabric strip 8 and the outer fabric strip 9 as the elongated structural body 6 is positioned in between the inner fabric strip 8 and the outer fabric strip 9. In order to effectively house the elongated structural body 6 within the band sleeve 7, the inner fabric strip 8 is positioned onto and along the outer fabric strip 9, and the first lengthwise edge 10 is positioned parallel and offset from the second lengthwise edge 11. The elongated structural body 6 is secured in between the inner fabric strip 8 and the outer fabric strip 9 as the first lengthwise edge 10 of the inner fabric strip 8 is stitched along the first lengthwise edge 10 of the outer fabric strip 9 by the first fastening seam 12. Similarly, the second lengthwise edge 11 of the inner fabric strip 8 is stitched along with the second lengthwise edge 11 of the outer fabric strip 9 by the second fastening seam 13.

In order to preserve both the elongated structural body 6 and the band sleeve 7, the present invention may further comprise a first cap 18 and a second cap 19, seen in FIG. 5. The first cap 18 and the second cap 19 keep the plurality of interwoven steel wire strands of the security cable 17 together and prevents the unwinding of the plurality of interwoven steel wire strands. The first cap 18 and the second cap 19 prevent the sharp ends of the security cable 17 from tearing through the elongated structural body 6 and the band sleeve 7. As the security cable 17 is positioned within the anchoring band 1, specifically the elongated structural body 6, the first cap 18 and the second cap 19 are integrated into the anchoring band 1. The first cap 18 is terminally mounted with the security cable 17, and the second cap 19 is mounted adjacent with the security cable 17, opposite the first cap 18, thereby surrounding both ends of the security cable 17.

Although the invention has been explained in relation to its preferred embodiment, it is to be understood that many other possible modifications and variations can be made without departing from the spirit and scope of the invention as hereinafter claimed.

What is claimed is:

1. A theft-prevention anchoring device comprises:

an anchoring band;

a band fastener;

a security cable;

the anchoring band comprises a first band end, a second band end, an inner planar surface, and an outer planar surface;

the band fastener comprises a first interlocking piece and a second interlocking piece;

the first band end being positioned opposite the second band end along the anchoring band;

the inner planar surface being positioned opposite the outer planar surface about the anchoring band;

the first interlocking piece being fixed onto the anchoring band, adjacent to the first band end;

the second interlocking piece being fixed onto the anchoring band, adjacent to the second band end;

the security cable being integrated into the anchoring band;

the security cable being positioned along the anchoring band;

the first interlocking piece being engaged to the second interlocking piece; and the first interlocking piece and the second interlocking piece being fixed onto the inner planar surface.

2. The theft-prevention anchoring device as claimed in claim 1 comprises:

the anchoring band further comprises an elongated structural body and a band sleeve;

the elongated structural body being positioned within the band sleeve; and, the security cable being integrated into the elongated structural body.

3. The theft-prevention anchoring device as claimed in claim 2 comprises:

the band sleeve comprises an inner fabric strip, an outer fabric strip, a first fastening seam, and a second fastening seam;

the inner fabric strip and the outer fabric strip each comprise a first lengthwise edge and a second lengthwise edge;

the elongated structural body being positioned in between the inner fabric strip and the outer fabric strip;

the inner fabric strip being positioned onto and along the outer fabric strip;

the first lengthwise edge being positioned parallel and offset from the second lengthwise edge;

the first lengthwise edge of the inner fabric strip being stitched along with the first lengthwise edge of the outer fabric strip by the first fastening seam; and, the second lengthwise edge of the inner fabric strip being stitched along with the second lengthwise edge of the outer fabric strip by the second fastening seam.

4. The theft-prevention anchoring device as claimed in claim 2, wherein the band sleeve is made of a fire-retardant material.

5. The theft-prevention anchoring device as claimed in claim 2, wherein the band sleeve is made of a cut-resistant material.

6. The theft-prevention anchoring device as claimed in claim 1, wherein the security cable is made of a cut-resistant material.

7. The theft-prevention anchoring device as claimed in claim 1 comprises:

a first cap;

a second cap;

the first cap and the second cap being integrated into the anchoring band;

the first cap being terminally mounted with the security cable; and, the second cap being mounted adjacent with security cable, opposite the first cap.

8. The theft-prevention anchoring device as claimed in claim 1, wherein the band fastener is a hook-and-loop band fastener, and wherein the first interlocking piece is a hooks portion of the hook-and-loop band fastener, and wherein the second interlocking piece is a loops portion of the hook-and-loop band fastener.

9. The theft-prevention anchoring device as claimed in claim 1, wherein the band fastener is a hook-and-loop band fastener, and wherein the first interlocking piece is a loops portion of the hook-and-loop band fastener, and wherein the second interlocking piece is a hooks portion of the hook-and-loop band fastener.

10. The theft-prevention anchoring device as claimed in claim 1, wherein the band fastener is configured to generate a loud audible sound as the first interlocking piece is disengaged from the second interlocking piece.

11. A theft-prevention anchoring device comprises:

an anchoring band;

a band fastener;

a security cable;

a first cap;

a second cap;

the anchoring band comprises a first band end, a second band end, an inner planar surface, an outer planar surface, an elongated structural body and a band sleeve;

the band sleeve comprises an inner fabric strip, an outer fabric strip, a first fastening seam, and a second fastening seam;

the inner fabric strip and the outer fabric strip each comprise a first lengthwise edge and a second lengthwise edge;

the band fastener comprises a first interlocking piece and a second interlocking piece;

the first band end being positioned opposite the second band end along the anchoring band;

the inner planar surface being positioned opposite the outer planar surface about the anchoring band;

the first interlocking piece being fixed onto the anchoring band, adjacent to the first band end;

the second interlocking piece being fixed onto the anchoring band, adjacent to the second band end;

the security cable being integrated into the anchoring band;

the security cable being positioned along the anchoring band;

the first interlocking piece being engaged to the second interlocking piece;

the elongated structural body being positioned within the band sleeve;

the security cable being integrated into the elongated structural body;

the first cap and the second cap being integrated into the anchoring band;

the first cap being terminally mounted with the security cable;

the second cap being mounted adjacent with security cable, opposite the first cap;

the elongated structural body being positioned in between the inner fabric strip and the outer fabric strip;

the inner fabric strip being positioned onto and along the outer fabric strip;

the first lengthwise edge being positioned parallel and offset from the second lengthwise edge;

the first lengthwise edge of the inner fabric strip being stitched along with the first lengthwise edge of the outer fabric strip by the first fastening seam; and, the second lengthwise edge of the inner fabric strip being stitched along with the second lengthwise edge of the outer fabric strip by the second fastening seam.

12. The theft-prevention anchoring device as claimed in claim 11, wherein the band sleeve is made of both a fire-retardant material and a cut-resistant material.

13. The theft-prevention anchoring device as claimed in claim 11, wherein the security cable is made of a cut-resistant material.

14. The theft-prevention anchoring device as claimed in claim 11 comprises:

the first interlocking piece and the second interlocking piece being fixed onto the inner planar surface.

15. The theft-prevention anchoring device as claimed in claim 11 comprises:

the first interlocking piece being fixed onto the inner planar surface; and, the second interlocking piece being fixed onto the outer planar surface.

16. The theft-prevention anchoring device as claimed in claim 11, wherein the band fastener is a hook-and-loop band fastener, and wherein the first interlocking piece is a hooks portion of the hook-and-loop band fastener, and wherein the second interlocking piece is a loops portion of the hook-and-loop band fastener.

17. The theft-prevention anchoring device as claimed in claim 11, wherein the band fastener is a hook-and-loop band fastener, and wherein the first interlocking piece is a loops portion of the hook-and-loop band fastener, and wherein the second interlocking piece is a hooks portion of the hook-and-loop band fastener.

18. The theft-prevention anchoring device as claimed in claim 11, wherein the band fastener is configured to generate a loud audible sound as the first interlocking piece is disengaged from the second interlocking piece.

* * * * *